US010757997B2

(12) United States Patent
Warner

(10) Patent No.: US 10,757,997 B2
(45) Date of Patent: Sep. 1, 2020

(54) SANDAL

(71) Applicant: Meredith Ann Warner, Baton Rouge, LA (US)

(72) Inventor: Meredith Ann Warner, Baton Rouge, LA (US)

( * ) Notice: Subject to any disclaimer, the term of this patent is extended or adjusted under 35 U.S.C. 154(b) by 129 days.

(21) Appl. No.: 15/839,931

(22) Filed: Dec. 13, 2017

(65) Prior Publication Data

US 2018/0098598 A1 Apr. 12, 2018

Related U.S. Application Data

(63) Continuation of application No. 13/103,746, filed on May 9, 2011, now Pat. No. 9,867,419.

(51) Int. Cl.

| | |
|---|---|
| ***A43B 3/12*** | (2006.01) |
| ***A43B 3/10*** | (2006.01) |
| ***A43B 13/14*** | (2006.01) |
| ***A43B 13/18*** | (2006.01) |
| ***A43B 13/16*** | (2006.01) |
| ***A43B 7/14*** | (2006.01) |
| *A43B 7/22* | (2006.01) |
| *A43B 3/08* | (2006.01) |

(52) U.S. Cl.

CPC ..... *A43B 3/128* (2013.01); *A43B 3/108* (2013.01); *A43B 7/141* (2013.01); *A43B 13/141* (2013.01); *A43B 13/145* (2013.01); *A43B 13/16* (2013.01); *A43B 13/186* (2013.01); *A43B 3/08* (2013.01); *A43B 3/12* (2013.01); *A43B 7/22* (2013.01)

(58) Field of Classification Search

CPC ..... A43B 7/145; A43B 3/12; A43B 3/128; A43B 3/126

USPC ..... 36/11.5

See application file for complete search history.

(56) References Cited

U.S. PATENT DOCUMENTS

| | | | | |
|---|---|---|---|---|
| 4,419,836 A * | 12/1983 | Wong | A43B 3/108 | 36/11.5 |
| 5,579,591 A * | 12/1996 | Kousaka | A43B 7/14 | 36/25 R |
| 6,170,176 B1 * | 1/2001 | Clough | A43B 7/145 | 36/117.5 |
| 6,983,555 B2 * | 1/2006 | Lacorazza | A43B 5/00 | 36/102 |
| 7,832,119 B2 * | 11/2010 | Gilmore | A61F 5/14 | 36/143 |

* cited by examiner

*Primary Examiner* — Timothy K Trieu

(74) *Attorney, Agent, or Firm* — Russel O. Primeaux; Lauren J. Rucinski; Kean Miller LLP

(57) ABSTRACT

An improved sandal with several orthotic benefits is provided. The sandal has a unique combination of features what will be useful for the treatment and prevention of plantar fasciitis. The improved sandal has a medial split in the medial heel section of the sole. The medial split is designed so that it absorbs more energy than the other parts of the heel and promotes a lateral to medial rotation of the heel portion during the wearer's gait. In a preferred embodiment, the sandal will include a rocker bottom sole and raised bed for the big toe that begins its rise at the metatarsophalangeal joint. In an additional preferred embodiment, the sole of the sandal will also include a metatarsal bar that supports the traverse arch and an upward bend that begins to rise from the sole at a point just forward of the end of the medial split and intersects with the metatarsal bar.

6 Claims, 3 Drawing Sheets

SANDAL

CROSS REFERENCE TO RELATED APPLICATIONS

This application claims priority to the U.S. patent application Ser. No. 13/103,746 titled "SANDAL" filed on May 9, 2011.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DETAILED DESCRIPTION

Figure 1:
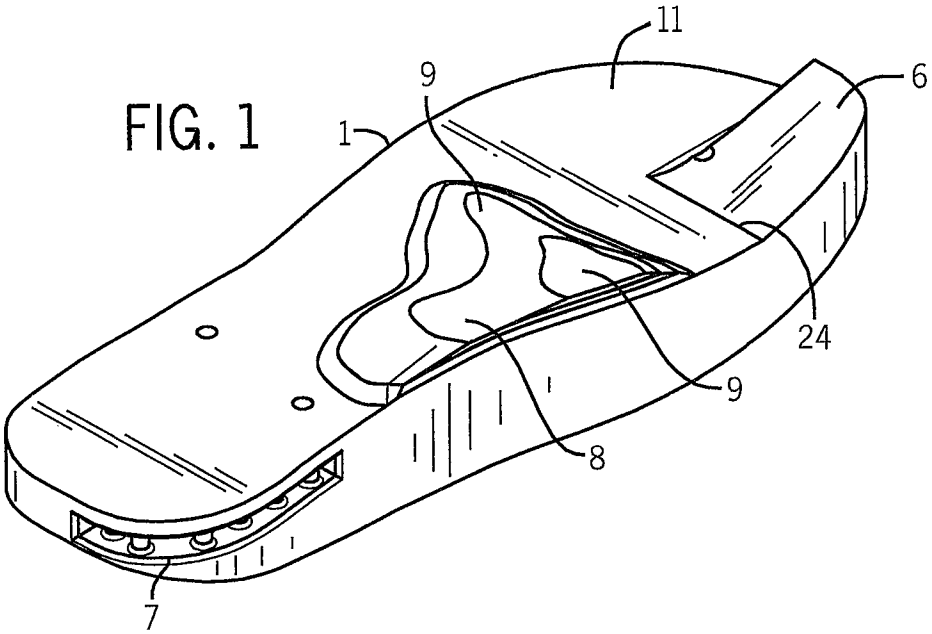
FIG. 1 is a depiction of one embodiment of the sandal from a perspective view—the left sandal is shown.

An improved sandal with several orthotic benefits is described herein. It is believed that the sandal can be used for the treatment and prevention of plantar fasciitis. As depicted in FIG. 1, the sandal has sole 1. Sole 1 will include big toe rise 6, medial split 7, upward bend 8 and metatarsal bar 9. All the figures show that upward bend 8 and metatarsal bar 9 are contiguous, integrated components.

Figure 3:
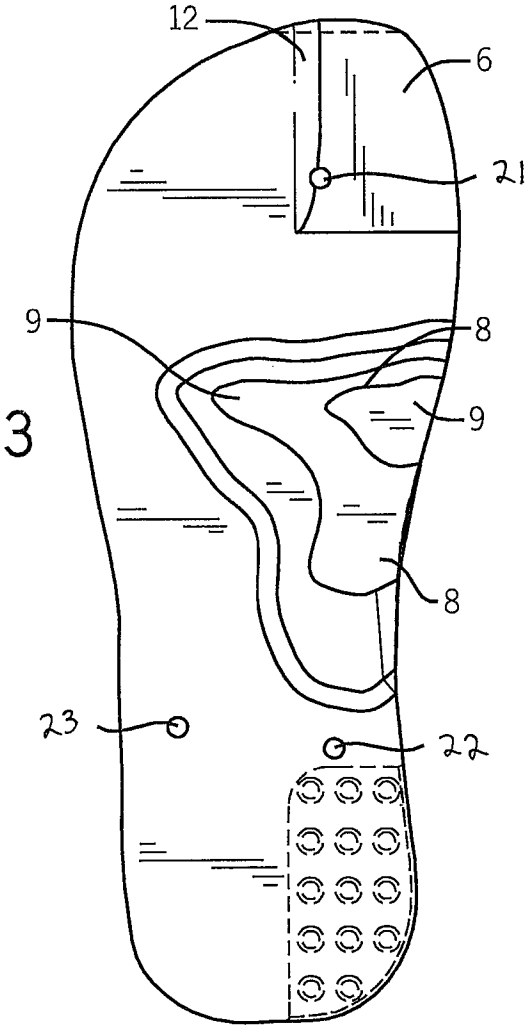
FIG. 3 is a top view of one embodiment of the left sandal. This view shows one embodiment of the medial split feature in cutaway.
Figure 2:
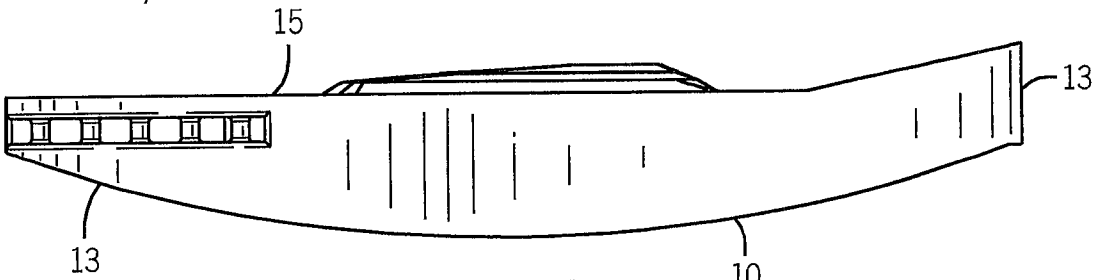
FIG. 2 is a side view of one embodiment of the left sandal. The view is from the inside of the sandal, also known as the medial side, looking to the wearer's left.
Figure 6:
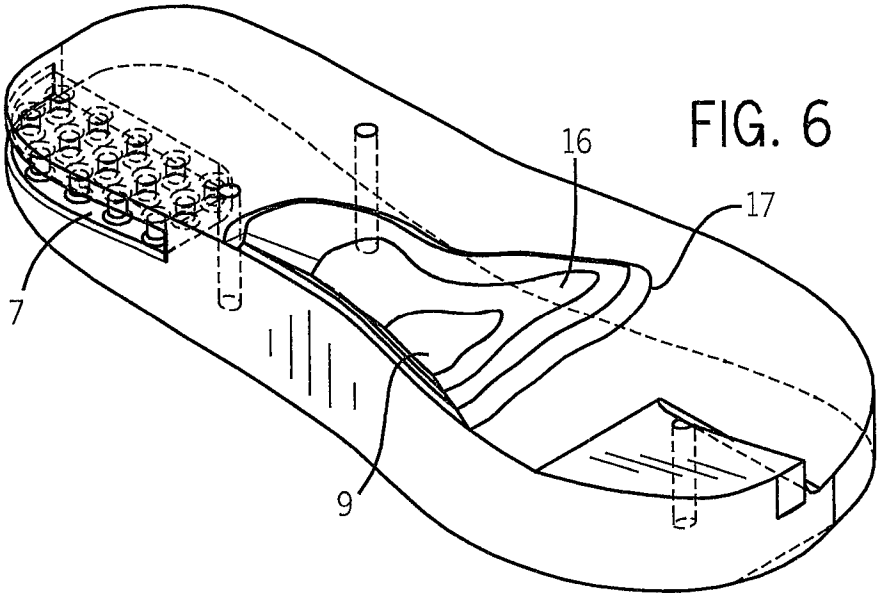
FIG. 6 is a depiction of one embodiment of the left sandal from another perspective view. This view also shows the strap attachment apertures and medial split in cutaway view.

As shown in FIG. 2, sole 1 has rocker bottom 10. When the wearer is in a neutral position, only the center of sole 1 will be in contact with the ground surface. The elevations in the front and back sections of rocker bottom 10 will be slightly off the floor. As shown in FIG. 3, the sandal will have a shape that is generally in the broad outline of an anatomically correct foot. The anatomically correct foot includes slight medial angulation of the hind foot and slight adduction of the mid and forefoot. The overall design of the rocker bottom sole is designed to be sharp enough to decrease tension on the plantar fascia, but shallow enough to allow only gentle balance motions to promote massage of the fascia and strengthening of the intrinsic muscles of the foot as well as the dynamic stabilizing muscles of the ankle.

Big toe rise 6 is designed so that the wearer's big toe is higher than the other toes. The wearer's other toes rest on lateral toe bed 11 which is lower than big toe rise 6. Big toe rise 6 is sized so as to lift the wearer's big toe higher than the remaining toes. Big toe rise 6 begins approximately at metatarsophalangeal (MTP) joint point 24 of sole 1. MTP joint point 24 approximately coincides with the wearer's first MTP joint of the big toe. In one preferred embodiment, big toe rise 6 will rise up from MTP joint point 24 going toward the front of sole 1 at an angle of approximately 5 to 20 degrees. As shown in FIGS. 1 and 3, in one preferred embodiment, toe slope 12 will connect lateral toe bed 11 and big toe rise 6 to provide greater comfort for the wearer. In an additional preferred embodiment, big toe rise 6 begins just at the level of the sesamoid bones and provides a cushion for these bones. In an additional preferred embodiment the angulation of the big toe rise will be approximately 15 to 20 degrees.

It is believed that toe rise 6 will promote the windlass mechanism of the plantar fascia. The windlass mechanism describes how the plantar fascia is pulled taut during the wearer's gait. The windlass mechanism is caused by the dorsiflexion of the first MTP joint during the phase of gait known as "toe-off." The toe-off phase occurs as the body moves over the planted foot. The foot moves in a slightly rotational way, spinning from the fifth metatarsal head, along the ball of the foot, to the first MTP joint. At that point in the gait cycle, the MTP joint flexes and the plantar fascia pulls taught. The heel is tipped into varus and the posterior tibial muscle fires. This initiates heel rise, then the achilles mechanism allows for push-off. Plantar fasciitis is caused by an imbalance at any point of this complex relationship during the gait cycle. This problem is often exacerbated by those with varus hindfeet, stiff first MTP joints and neutral to cavus midfeet. The improved sandal is designed to accommodate the biomechanical forces that promote and exacerbate plantar fasciitis. By assisting in forward roll with a rocker-bottom, using tread design to accommodate the lateral to medial spin during gait, cushioning the origin of the plantar fascia with the medial split and assisting the windlass mechanism with the toe rise, the sandal described herein will allow for improvement in the symptoms of plantar fasciitis.

The gait cycle begins with heel strike. Historically, it was thought that the hindfoot struck the ground in a position of eversion. However it is more likely that the heel strikes in slight varus and quickly moves to eversion as the foot moves to foot-flat during gait. Sole 1 has a slight lateral to medial curve with rises on each side and contact being more centralized at the heel. This shape of sole 1 will assist the wearer in this natural motion. As the heel strikes in varus, the lateral portion of the hindfoot sole will easily accommodate this force. As the heel moves to eversion the medial portion of the posterior sole will allow for lesser impact on the calcaneus and plantar fascia. Medial split 7 is limited to the posterior medial aspect of the heel in order to allow for enough support during gait. Medial split 7 allows for a slightly less amount of energy to be absorbed by the calcaneus in the region of the plantar fascia insertion. Often, in plantar fasciitis, this region of bone has stress changes consistent with "bone bruising." Medial split 7 and the overall design of the sandal aim to lessen the pain associated with this type of bone bruising.

With reference to all the figures, medial split 7 will now be described in greater detail. Medial split 7 is a void or cut out section of sole 1. The location of medial split is at the back of sole 1, behind upward bend 8 and metatarsal bar 9. Medial split 7 is designed so that when the wearer initially strikes heel 13 against the ground surface, the wearer's weight will be equally supported medially and laterally. However, as the wearer's weight on heel 13 is increased, medial split 7 will compress more than the lateral section of heel 13. The compression effect will absorb energy from the medial portion of the heel while still providing some suspension for the medial heel strike. The purpose of this feature is to promote a lateral to medial rotation of the heel portion and reduce wearer heel pain.

In the embodiment shown, medial split takes up approximately 25% of the length of sole 1 and 50% of the width of sole 1 at heel 13. In a preferred embodiment, medial split extends forward from heel 13 and terminates at the mid-arch section 15 of sole 1. It is believed that medial split 7 can perform its desired functions described above if it takes between 20% and 30% of the length of sole 1 and 30% to 50% of the width of sole 1.

Figure 5:
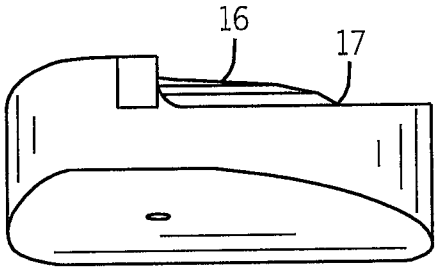
FIG. 5 is a front view of one embodiment of the left sandal. The view is from the inside, or medial side, of the sandal looking to the wearer's left.
Figure 4:
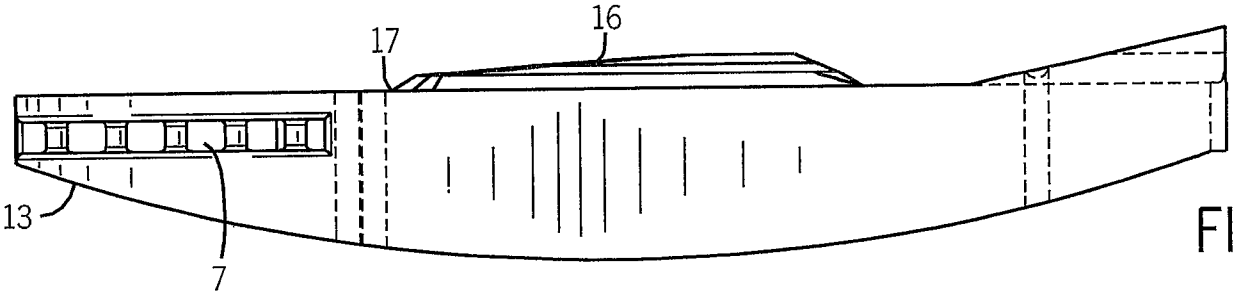
FIG. 4 is a side view of one embodiment of the left sandal. The view is from the inside, or medial side, of the sandal looking to the wearer's left. This view also shows the apertures for the strap attachment points in cutaway.

All the figures except FIG. 5 show that in one embodiment, medial split 7 can be constructed by a void in sole 1 that is then partially filled by columns 11. Material for columns 11 is chosen so that medial split 7 will compress more than the surrounding sections of sole 1 during the gait of the wearer.

The remainder of sole 11 is constructed of conventional materials used in sandal construction. Those skilled in the art will know that the sole can be constructed in a single layer using ethylene vinyl acetate (EVA), polyurethane surrounding another material such as gel or liquid silicone, or polyurethane foam. In some cases, those skilled can construct sole 1 in layers, including but not limited to a top layer, midsole, and outsole. If layers are used, the insole is typically a thin layer of EVA. The midsole, which is usually the thickest layer, consists of polyurethane surrounding another material such as gel or liquid silicone, or polyurethane foam. Outsoles are usually made of some type of rubber. Those skilled in the art may also choose to use cork or wood as materials, or any material which may be fashioned using injection molding or three-dimensional sculpting with Computer Aided Design (CAD) devices. It will be obvious to those skilled in the art to use a variety of such materials for the sole 1, and this invention is not intended to be limited to any particular materials used in sole 1.

While in the embodiment depicted, medial split 7 is a void partially filled with columns, medial split 7 could also be designed in other ways to create the same results during the wearer's gait. Medial split 7 could be a void only, in which case the material immediately adjacent the void would need to have greater density and flexion resistance so as to allow some compression but also some medial support through the wearer's heel strike and gait. Medial split 7 could also be constructed by using material that is less dense in this section of the sole. Medial split 7 could also be constructed by a void that is partially occupied by structures other than columns 11. For example, the void could be partially occupied by honeycomb structures or by parallel wall structures oriented in any direction.

Figure 9:
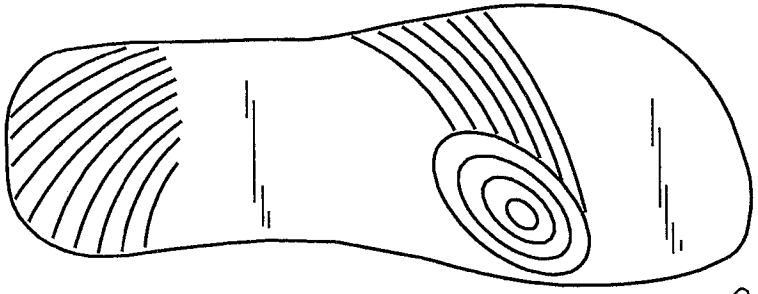
FIG. 9 is a view of one embodiment of the sole bottom that includes a swirl tread design.

As shown in the embodiment in FIG. 9, sole 11 can include a tread pattern with a ball and swirl design. This tread pattern will promote the lateral to medial spin of the wearer's foot during the gait. Those skilled in the art will be familiar with variations of the ball and swirl tread design that will perform the desired function.

Metatarsal bar 9 serves to support the transverse arch. The transverse arch of the foot is the arch that runs along the mediolateral axis of the foot. As shown in FIG. 5, bar mid-section 16 is higher than bar lateral section 17. As the upwardly curved shape of metatarsal bar 9 supports the transverse arch, it is believed that this shape will help to prevent collapse of the middle foot as the windlass mechanism is activated.

The medial longitudinal arch, that is usually associated with the concept of 'arch' in the foot, is also supported in terms of function by the transverse arch. The transverse arch is formed at the bony level by the association of the cuneiforms as they articulate with the metatarsals. The apex of this arch is at the position of the 2nd metatarsal bone. If the transverse arch is accommodated and there is less stress on the keystone position of this arch, there is less stress on the medial longitudinal arch. The improved sandal, with its strong structural transverse arch, will reduce the force required by the posterior tibial muscle, the main dynamic stabilizer of the foot. Therefore, most of this muscle and tendon unit's force will go toward stabilizing the apex of the medial longitudinal arch. This reduces the stress on either end of the tie-rod of that arch. Arches have forces at each inferior point with compression of the apex of the arch. The vector of force is typically away from these points as the apex depresses with load. A tie-rod connects the two bottom points of the arch. As the arch depresses, and therefore widens, these ends of the tie-rod must handle the tension applied. In the foot, the ends of the tie-rod at the origin of the plantar fascia and the first metatarsophlangeal joint. The improved sandal design will promote a reduction in the tension applied at the point of origin of the plantar fascia and thereby decrease pain.

As shown in the figures, metatarsal bar 9 is partially integrated with gently sloped upward bend 8. Upward bend 8 begins to rise from sole 1 at a point just forward of the terminus of medial split 7 and reaches its highest point at its intersection with metatarsal bar 9. Upward bend 8 then slopes downward again, terminating at sole 1 at a point slightly behind big toe rise 6. Upward bend 8 also serves to support the arch during the activation of the windlass mechanism.

Figure 7:
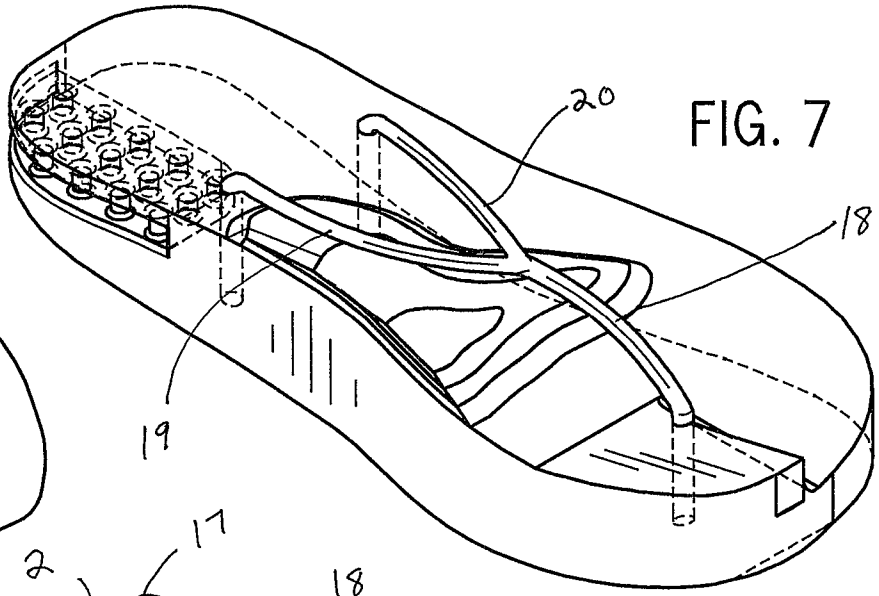
FIG. 7 is a perspective view of the one embodiment of the left sandal that shows the strap.
Figure 8:
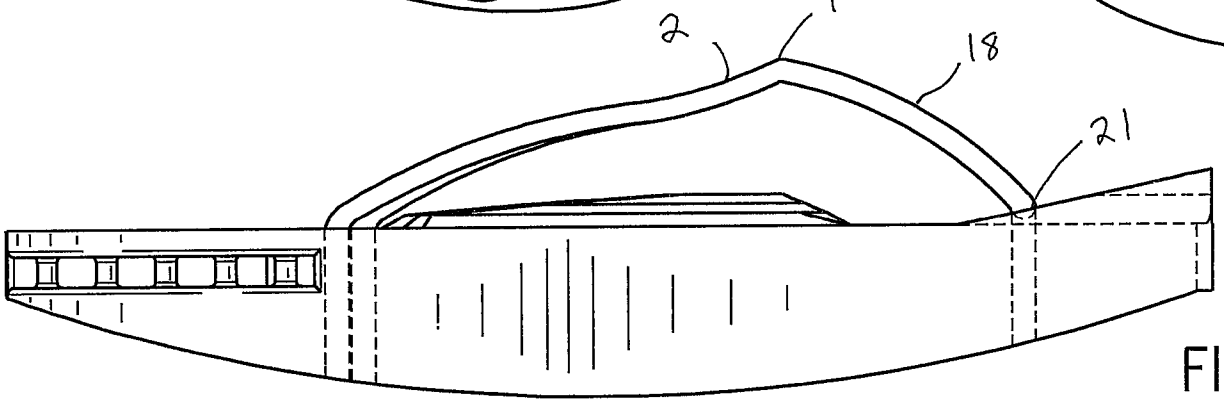
FIG. 8 is an additional perspective view of one embodiment of the left sandal that shows the strap.

As shown in FIGS. 5, 7, and 8, the sandal will include strap 2. Strap 2 includes strap junction 17, anterior segment 18, medial segment 19, and lateral segment 20. Anterior segment 18 extends from strap junction 17 to anterior attachment point 21. Preferably anterior attachment point 21 is located on sole 1 at a point in or proximate to big toe rise 6. Medial segment 19 extends from strap junction 21 to medial attachment point 22. Preferably medial attachment point 22 is located on sole 1 at a point in or immediately forward of medial split 7. In one preferred embodiment, medial section 19 originates from the front edge of medial split 7. Lateral segment 20 extends from strap junction 21 to lateral attachment point 23. Preferably lateral attachment point 23 is located on sole 1 at a point near the medial edge of sole 1 but at a point on the long axis of sole 1 that is approximately even with medial attachment point 22.

In one preferred embodiment, strap 17 is constructed so that its segments have varying densities. Specifically, the density and stiffness of medial segment 19 and lateral segment 20 are greater than the density and stiffness for strap junction 17 and anterior segment 18. It is believed that having relatively greater stiffness and density in medial segment 19 and lateral segment 20 will keep metatarsal bar 9 and upward bend 8 engaged with the transverse arch of the wearer during the wearer's gait.

The combination of the elements will provide therapeutic effects for those wearers who suffer from plantar fasciitis and preventative effects for those who do not. The rocker sole 10 with a gentle medial to lateral rise also present in the hindfoot again allows for reduced tension on the tie-rod or the medial longitudinal arch, or plantar fascia, during gait. As the foot moves from heel-strike to foot-flat to toe-off, the improved sandal provides a biomechanical assistive portion at each moment designed to reduce the stress on the plantar fascia and yet allow efficient gait. It is believed that the combination of all of these biomechanical elements in this design will allow for a reduction in plantar fascia pain for those suffering this debilitating disease. The treatment of plantar fasciitis by this improved sandal a far more cost effective treatment for this problem than any invasive treatments now available.

Any and all references to patents, documents, and other writings contained herein shall not be construed as an admission as to their status with respect to being or not being prior art.

The described features, advantages, and characteristics may be combined in any suitable manner in one or more embodiments. One skilled in the relevant art will recognize that the various components of this design may be practiced without one or more of the specific features or advantages of a particular embodiment. In other instances, additional features and advantages may be recognized in certain embodiments that may not be present in all embodiments.

Reference throughout this specification to "one embodiment", "an embodiment", or similar language means that a particular feature, structure, or characteristic described in connection with the embodiment is included in at least one embodiment. Thus the appearance of the phrase "in one embodiment", "in an embodiment", and similar language throughout this specification may, but do not necessarily, all refer to the same embodiment.

The invention may be embodied in other specific forms without departing from the spirit or essential characteristics thereof. The present embodiments are therefore considered in all respects as illustrative and not restrictive. Accordingly, the scope of the invention is established by the appended claims rather than the foregoing description. All changes which come within the meaning and range of equivalency of the claims are therefore intended to be embraced therein.

Moreover, the terms "substantially" or "approximately" as used herein may be applied to modify any quantitative representation that could permissibly vary without resulting in a change to the basic function to which it is related.

PARTS LIST sole 1
strap 2
front strap 3
medial strap 4
lateral strap 5
big toe rise 6
medial split 7
upward bend 8
metatarsal bar 9
rocker bottom 10
lateral toe bed 11
toe slope 12
heel 13
columns 14
mid-arch section 15
bar midsection 16
strap junction 17
anterior segment 18
medial segment 19
lateral segment 20
anterior attachment point
medial attachment point 22
lateral attachment point 23
MTP joint point 24

The invention claimed is:

1. A sandal comprising:
a. a sole having a rocker bottom and a heel;
b. a medial split located only in the medial portion of said heel; and
c. a strap connected to said sole.

2. The sandal of claim 1, further comprising:
a. a metatarsal bar running along the mediolateral axis of said sole, said metatarsal bar having a mid-section and a lateral section, said mid-section being higher than said lateral section; and
b. a medial to lateral rise in the hindfoot section of said sole.

3. The sandal of claim 2, further comprising:
a. said sole further comprising an MTPJ point; and
b. an upward bend along the medial portion of said sole, said upward bend beginning at a point just forward of the forward terminus of said medial split, continuing and reaching its highest point at its intersection with said metatarsal bar, and sloping downward until terminating at said sole at a point slightly behind said MTPJ point; and
c. wherein said upward bend is partially integrated with the metatarsal bar.

4. A sandal comprising:
a. a sole having a heel and an MTPJ point, said MTPJ point corresponding with the metatarsophalangeal joint of a user when worn;
b. a medial split located only in the medial portion of said heel;
c. a rise corresponding with a big toe of the user when worn, said rise beginning approximately at said MTPJ point and continuing toward the front of said sole; and
d. a strap connected to said sole.

5. The sandal of claim 4, further comprising:
a. a metatarsal bar running along the mediolateral axis of said sole, said metatarsal bar having a mid-section and a lateral section, said mid-section being higher than said lateral section; and
b. said big toe having an angle of 15 to 20 degrees from the general horizon orientation of said sole.

6. A sandal comprising:
a. a sole having a heel;
b. a medial split located only in the medial portion of said heel;
c. a metatarsal bar running along the mediolateral axis of said sole, said metatarsal bar having a mid-section and a lateral section, said mid-section being higher than said lateral section; and
d. a strap connected to said sole.

* * * * *